United States Patent [19]

Murray

[11] Patent Number: 4,541,137

[45] Date of Patent: Sep. 17, 1985

[54] BEDDING HOLDER

[76] Inventor: Lester K. Murray, 16717 Maplewild SW., Seattle, Wash. 98166

[21] Appl. No.: 555,062

[22] Filed: Nov. 28, 1983

[51] Int. Cl.[4] ..... A47C 21/02

[52] U.S. Cl. ..... 5/498; 5/508; 24/72.5

[58] Field of Search ..... 5/426, 498, 508, 496; 24/72.5, 489, 490

[56] References Cited

U.S. PATENT DOCUMENTS

| | | | |
|---|---|---|---|
| 672,881 | 4/1901 | Allen | 5/498 |
| 959,763 | 5/1910 | Lehr | 5/498 |
| 1,402,796 | 1/1922 | Rodkey | 5/498 |
| 1,760,346 | 5/1930 | Correa | 5/498 |
| 1,982,998 | 12/1934 | Matchett | 24/72.5 |
| 2,605,524 | 8/1952 | Marchese | 24/72.5 |

*Primary Examiner*—Gary L. Smith
*Assistant Examiner*—Michael F. Trettel
*Attorney, Agent, or Firm*—Morris A. Case; Morris A. Case

[57] ABSTRACT

An elongated flat arm is joined at one end to the outer side of one of a pair of spaced apart legs, with that leg extending at about 90 degrees to the arm. The legs are joined together at one end, and are open ended at the other end. Inwardly directed cooperating projections are located adjacent the open end. A latch having a knobbed end is joined intermediate the length of the joined leg, and that latch extends towards and works in combination with an opening through the opposite leg to hold the legs together.

12 Claims, 6 Drawing Figures

Fig. 1
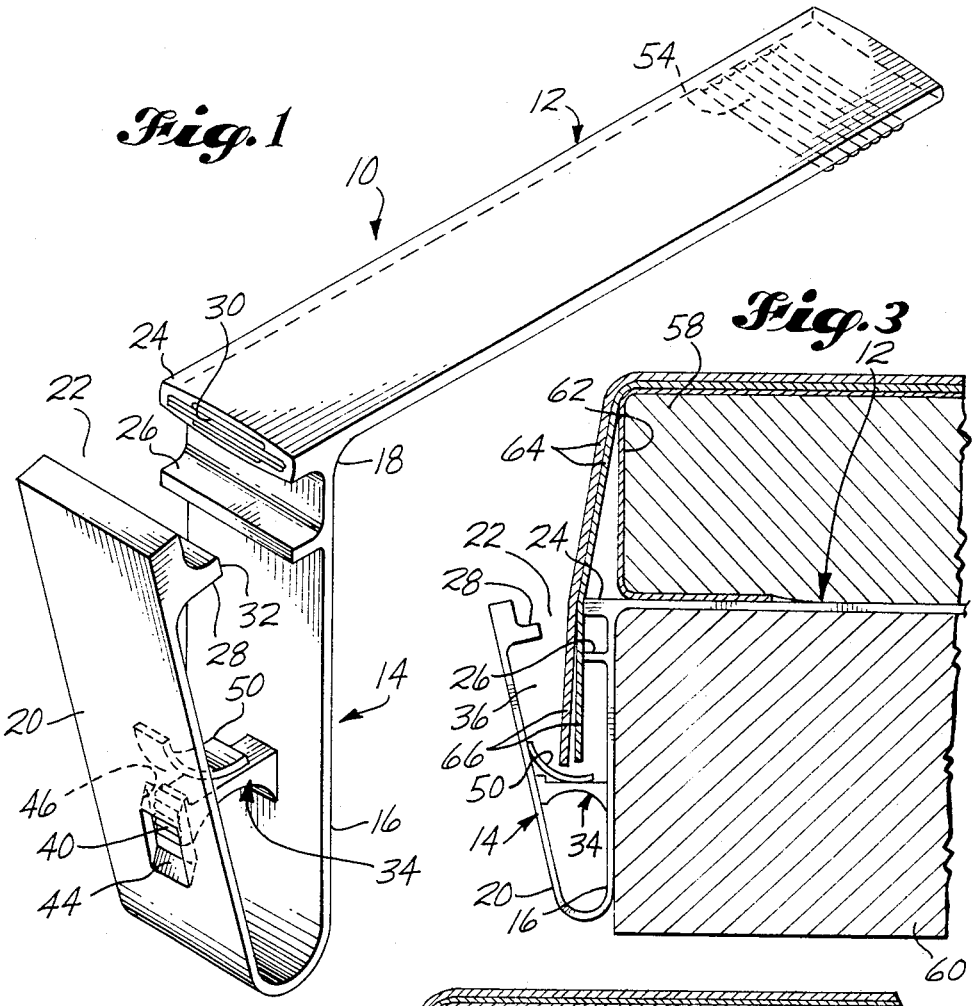
Fig. 3
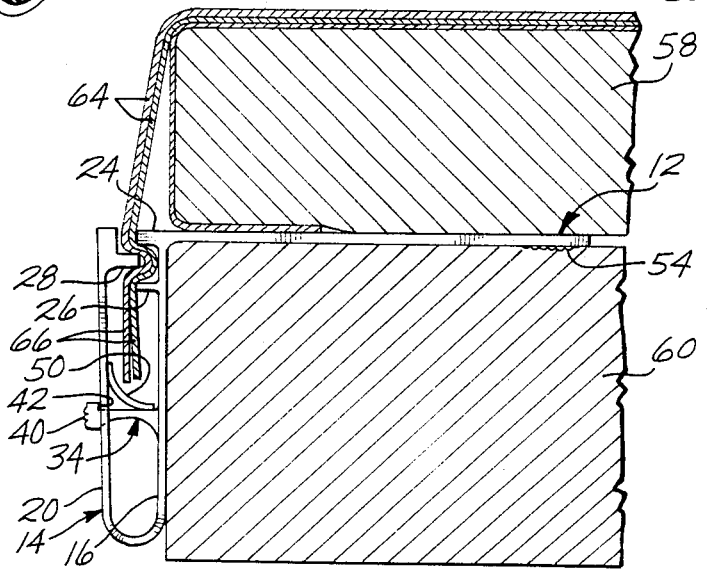
Fig. 4

Fig. 2
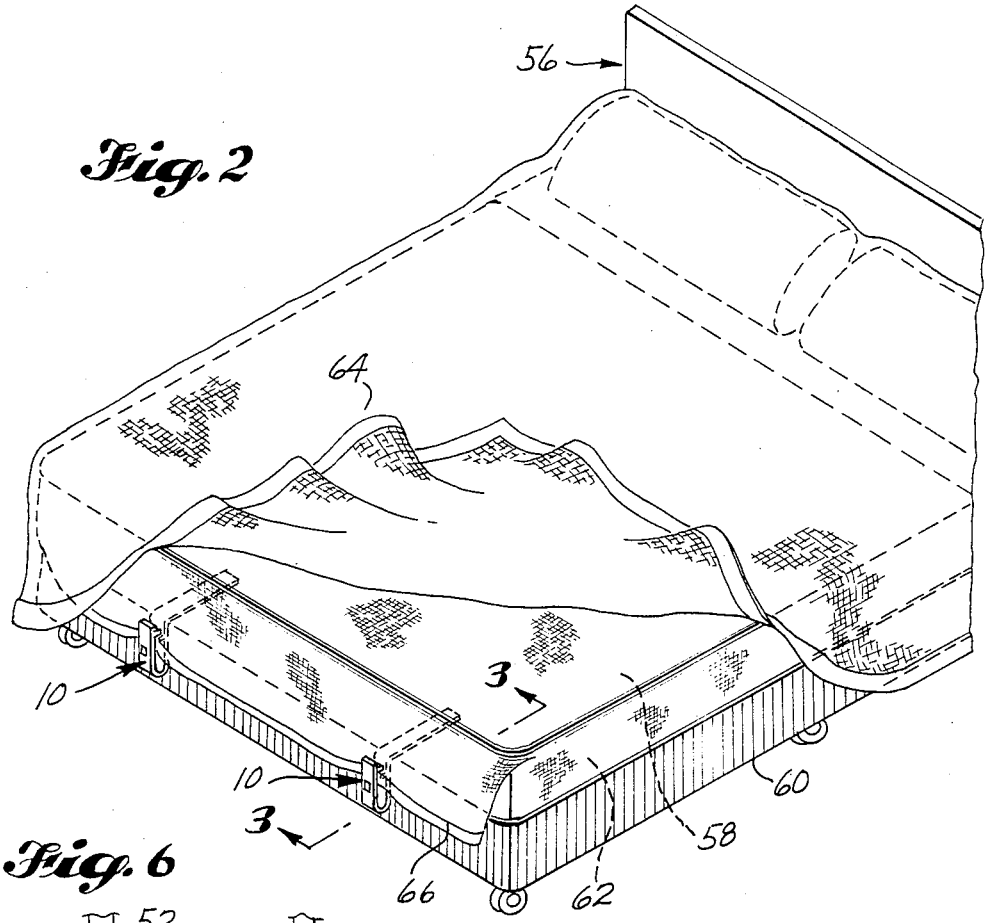
Fig. 6
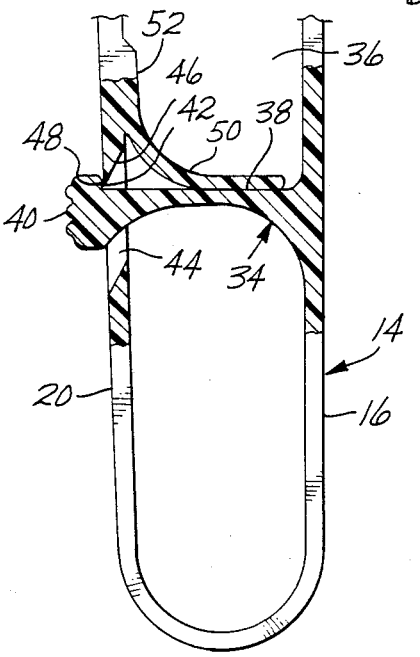
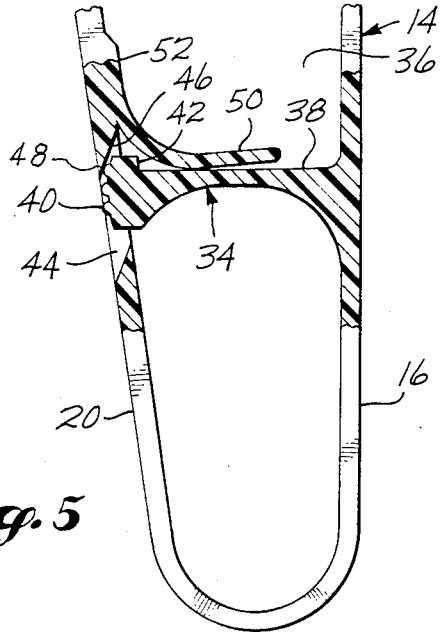
Fig. 5

BEDDING HOLDER

BACKGROUND OF THE INVENTION

Retaining sheets, blankets and other bedclothes in position have long been a problem as one's normal changing of position while sleeping tends to pull the tucked in bedding loose to expose one to the cold. It is often necessary with children not only to tuck the covers between the mattress and box springs at the bottom of the bed, but also along the sides, and even then they manage to pull the covers loose. This requires continual checking to insure that they are properly covered. Even with adults it becomes a problem, as the covers often are pulled loose to expose them to the cold.

It was found that the bedclothes may be properly kept in place with the bedding holder of this invention.

SUMMARY OF THE INVENTION

An elongated arm is shaped to extend between a mattress and a mattress supporting surface. A deep U-shaped holding member is attached at one end of the arm with the open end of the U having inwardly directed cooperating projections. A latching mechanism extends between the legs of the U to latch the legs together with the inwardly directed projections fastened on bedding to be held.

DESCRIPTION OF THE DRAWINGS

FIG. 1 shows a perspective view of the bedding holder of this invention.

FIG. 2 shows a perspective view of a pair of holders of FIG. 1, in use on a bed.

FIG. 3 shows a cross-sectional view along the line 3—3 of FIG. 2, with the bedding holder as in FIG. 1, with the holder opened to receive the ends of bedding.

FIG. 4 shows a cross-sectional view as in FIG. 3, but with the holder latched closed and holding the bedding.

FIGS. 5 and 6 are fragmented blown up end views, partially in cross-section, of the bedding holder with FIG. 5 having the holder open to receive bedding and FIG. 6 having the holder latched together for retaining the bedding.

DETAILED DESCRIPTION

Bedding holder 10, has an elongated essentially flat arm 12, and a member 14, made up of a pair of spaced apart legs joined together at one end with this member preferably of a U-shape. This member has the first leg 16, joined adjacent one end 18, of the elongated arm. This leg extends away from the arm at an angle of about 90 degrees. This leg may be joined to the arm at any place along the outer side of the leg, but preferably is joined at its open end. The second leg 20, preferably extends outward at an angle to provide an enlarged opening at the open end 22, of the U-shaped member. The U-shaped member is essentially rigid, however, it has enough flexibility to easily be moved between the open and the closed position.

At the open end of the U-shaped member each leg has at least one inwardly extending projection. In a preferred embodiment those projections are as shown with leg 16, having a projection 24, at its upper end and a spaced apart lower projection 26. Leg 20 has a projection 28, that is located to extend between the two projections on leg 16, when the legs are held in the closed position. At the innermost side of projection 24, the surface 30 preferrably has lateral serrations or corrugations, and at the innermost side of the projection 28, the surface 32, preferably also has lateral corrugations.

The means of latching the U-shaped member 14 together is best shown in FIGS. 5 and 6. A semi-rigid latching member 34, is secured to and extends inwardly from leg 16. This member is located at a position intermediate with respect to the length of the leg; which gives a considerable space 36, above the member for the bed clothes to enter. The member is essentially flat along its top surface 38, has a knurled knob 40 at its end, and an upward rising surface 42 adjacent that end which acts as a catch. Leg 20 has an opening 44, having an outwardly bevelled surface 46 along the top of the opening with the bevelled surface located to be contacted by the knurled knob 40, of member 34 when the leg 20 is pushed toward leg 16. The member 34, has sufficient resilience for the knob to be moved downward due to the bevelled surface until the knob passes through opening 44, at which time the resilience of the member snaps the end of that member upward and the surface 42, will catch against the outside edge of leg 20 at 48. A strap 50, is joined at one end to the inside surface of leg 20 at 52; which is at a position above opening 44. The other end of the strap extends out over the top of latch member 34, and prevents bed clothes from catching between the leg and the member 34.

The arm 12, preferably has a series of laterally extending corregations at 54, to assist in keeping that arm in position.

The holder may be made up in various ways with the preferred embodiment being of a one piece construction molded from plastics. This may be prepared with many of the known plastics, with a high impact, high temperature styrene plastic preferred.

In operation preferrably two or more of the bedding holders 10, are used depending upon the width of the bed. FIG. 2 shows a bed with mattress 58; which is supported on box springs 60. In that Figure an under sheet 62, is shown which is of the contoured variety and will remain in place in and of itself. Covering bedding or bed covers 64, which may consist of sheets, blankets, quilts, etc. or a combination thereof is also shown and must be secured by bedding holders. To best understand the accomplishing of this see FIGS. 3 and 4. Each bedding holder, in the opened position, is located with arm 12, inserted between the mattress 58, and mattress support 60, with the open end of the U-shaped member up. With the holder open this provides considerable space 36, for the ends 66, of the bed covers 64 to be easily placed in the holder. The strap 50 acts as a diverter to prevent the ends from being caught between the latch and the leg. With the ends held between the legs of the holder, the leg 20, is pressed toward leg 16, until the latch member 34 snaps up and catch 42 rests against surface 48 to hold the legs together with the cooperating projections 24, 26, and 28 securing the ends of the bed covers. To release the bedcovers one presses down on knob 40, and the holder will snap open.

I claim:

1. A device for holding bedding in place comprising: an elongated arm to be inserted between a mattress and a mattress support, a deep essentially U-shaped section having one leg joined to the outer end of the inserted arm with the open end of the U-shaped section up and having inwardly directed cooperating projections, a support member joined to the inside of one leg extending toward the opposite leg and having a knob on the end, and the second leg having an opening sized and located to permit the knob to extend through and catch against a side of the opening to latch the legs with cooperating projections together and hold the bedding in place.

2. A device for holding bedding in place as in claim 1, further comprising: a covering strap secured on the inside of and above the opening in the leg with the covering member extending downward and inward toward the opposite leg.

3. A device for holding bedding in place as in claim 1, wherein the leg joined to the arm is joined adjacent the outer end of that leg.

4. A device for holding bedding in place as in claim 1, further comprising having the device of a one piece molded plastic.

5. A device for retaining bedding comprising: an elongated essentially flat arm, a pair of spaced apart legs joined together at one end and having a first one of the pair of legs joined at about 90 degrees to an end of the arm, at least one inwardly directed projection adjacent an open end of the first leg and at least one inwardly directed projection adjacent an open end of the second leg to in combination provide a holding means when the legs are brought together, the second leg having an opening located intermediate its length, and a latch member secured to a first leg to extend toward the opening on the second leg with the member having a knob to extend through the opening and catch against the outer side of the second leg when the second leg is pressed toward the first leg.

6. A device for retaining bedding as in claim 5, further comprising the opening in the second leg having an outwardly tapered upper surface located to be pressed against by the knob of the latch.

7. A device for retaining bedding as in claim 5, further comprising a cover strap having one end secured to the inside of the second leg and above the opening in that leg with the other end extending downward and inward.

8. A device for retaining bedding as in claim 5, further comprising: the arm having a series of laterally extending serrations, and at least one inwardly extending projection on each leg having laterally extending serrations along the inner surface of the projection.

9. A device for retaining bedding as in claim 5, further comprising the arm being joined to the open end of the first leg.

10. A device for retaining bedding as in claim 5, further comprising the device being of a one piece plastic construction.

11. A device for holding bedding in place as in claim 9, wherein the holder is formed with the second leg angled outward with respect to the first leg.

12. A device for retaining bedding as in claim 5, further comprising: the arm joined at the open end of the first leg, the second leg angled outward with respect to the first leg, the opening in the second leg having an outwardly tapered upper surface located to be pressed against by the knob, a cover member having one end secured to the inside of the second leg above the opening and the other end extending downward and inward, and the device preformed in one piece from plastic.

* * * * *